United States Patent [19]

Anglehart

[11] Patent Number: 5,071,039

[45] Date of Patent: Dec. 10, 1991

[54] VISCOUS LIQUID DISPENSING CONTAINER

[75] Inventor: James Anglehart, Montreal, Canada

[73] Assignee: Dwight Anglehart, Vancouver, Canada

[21] Appl. No.: 495,365

[22] Filed: Mar. 16, 1990

[51] Int. Cl.[5] ..... B67D 5/00

[52] U.S. Cl. ..... 222/158; 222/207; 222/211

[58] Field of Search ..... 222/211, 207, 158, 215

[56] References Cited

U.S. PATENT DOCUMENTS

| | | | |
|---|---|---|---|
| 3,157,319 | 11/1964 | Schwienbacher | 222/207 |
| 3,175,736 | 3/1965 | Pelto | 222/207 |
| 4,077,547 | 3/1978 | Donoghue | 222/207 |
| 4,168,020 | 9/1979 | Benson | 222/207 |
| 4,324,349 | 4/1982 | Kaufman | 222/207 |
| 4,640,441 | 2/1987 | Bunschoten | 222/207 |
| 4,645,097 | 2/1987 | Kaufman | 222/207 |
| 4,899,789 | 2/1990 | Carow | 222/207 |

FOREIGN PATENT DOCUMENTS

| | | | |
|---|---|---|---|
| 2038779 | 7/1980 | United Kingdom | 222/207 |

*Primary Examiner*—Michael S. Huppert
*Assistant Examiner*—Anthoula Pomrening

[57] ABSTRACT

There is disclosed a squeeze-container for dispensing a viscous liquid comprising a reservoir for holding the liquid (at least a part of the reservoir being resiliently squeezable), a measuring channel for measuring therein a quantity of the liquid to be dispensed, a spout in communication with an upper part of the channel, and an air trap including an air chamber, the air trap being in communication with a lower end of the channel and with substantially the bottom of the reservoir. The air trap is able in use to release an air bubble from the chamber into the lower end and to replenish the chamber with air. In this way, the quantity of liquid may be dispensed by squeezing the part of the reservoir to substantially fill the channel, causing the air trap to release the bubble, further squeezing to commence a flow of the liquid in the channel entraining the bubble until the bubble is released at the spout, releasing the container so that the chamber is replenished by air filling the channel and the air trap as the air enters the reservoir.

13 Claims, 2 Drawing Sheets

VISCOUS LIQUID DISPENSING CONTAINER

BACKGROUND OF THE INVENTION

The present invention relates to a viscous liquid dispensing container which permits a measuring of the liquid to be dispensed. The invention relates further to a viscous liquid dispensing container of the squeeze-bottle type.

It is known that viscous liquids are often difficult and messy to measure for dispensation, since the liquid is difficult to pour into a measuring cup and slow to remove from the measuring cup. It is therefore desirable to have a container which is able to dispense a measured quantity, so that the use of a measuring cup or the like is avoided.

Some of the viscous liquids which are advantageously dispensed from a container capable of measuring are: liquid detergent, shampoo, oil, syrup and honey.

SUMMARY OF THE INVENTION

An object of the invention is to provide a viscous liquid dispensing container which can be used to measure and dispense a quantity of viscous liquid.

Another object of the invention is to provide a viscous liquid dispensing container which can be used to measure a variable quantity of viscous liquid.

A further object of the invention is to provide a viscous liquid dispensing container which can be inexpensively made from one integral moulded piece.

According to the invention, there is provided a viscous liquid dispensing container for dispensing a viscous liquid comprising a reservoir for holding the liquid, pressure generating means for generating and releasing a pressure to expel the liquid from the reservoir, a measuring channel for measuring therein a quantity of the liquid to be dispensed, a spout in communication with an upper part of the channel, and air trap means including an air chamber, the air trap means being in communication with a lower end of the channel and with substantially a bottom of the reservoir. The air trap means are able in use to release an air bubble from the chamber into the lower end and to replenish the chamber with air.

According to the invention there is also provided a squeeze-container for dispensing a viscous liquid comprising a reservoir for holding the liquid (at least a part of the reservoir being resiliently squeezable), a measuring channel for measuring therein a quantity of the liquid to be dispensed, a spout in communication with an upper part of the channel, and air trap means including an air chamber, the air trap means being in communication with a lower end of the channel and with substantially a bottom of the reservoir. The air trap means are able in use to release an air bubble from the chamber into the lower end and to replenished the chamber with air. In this way, the quantity of liquid may be dispensed by squeezing the part of the reservoir to substantially fill the channel, causing the air trap means to release the bubble, further squeezing to commence a flow of the liquid in the channel entraining the bubble until the bubble is released at the spout, releasing the container so that the chamber is replenished by air filling the channel and the air trap means as the air enters the reservoir.

BRIEF DESCRIPTION OF THE DRAWINGS

The invention will now be better understood by way of the following description of a preferred embodiment with reference to the drawings wherein.

DETAILED DESCRIPTION OF THE PREFERRED EMBODIMENT

In the preferred embodiment, the squeeze-container 1 is used as a honey dispenser for dispensing a desired quantity of honey into a beverage such as tea or coffee. The container 1 is a one piece, moulded, translucid, squeezable plastic bottle. Channel 2 is provided outside reservoir 3. Container 1 is made from thermoplastic material such as polyethylene, by blow molding techniques in which an extruded parison is blown into the general shape of the container. The wall thickness of the container 1 is such that the walls are flexible while retaining the fabricated shape of the container 1.

Figure 1:
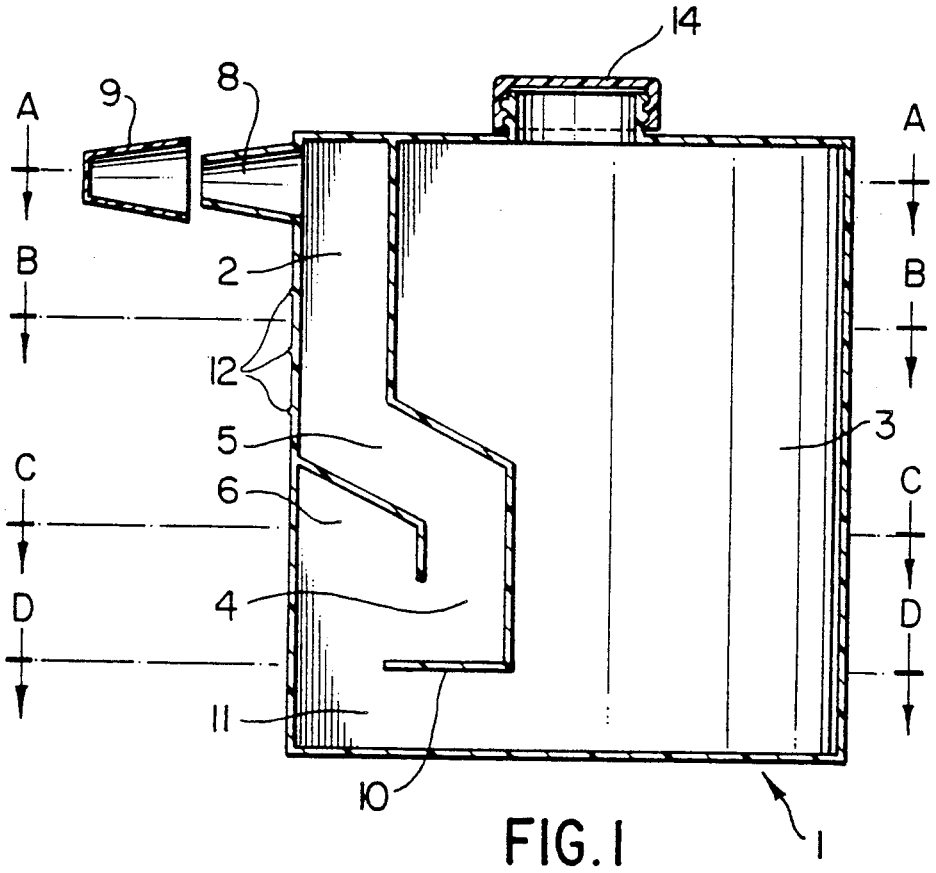
FIG. 1 is a side cross-sectional view of a squeeze container according to the preferred embodiment.

As shown in FIG. 1, the squeeze-container 1 has a reservoir 3, a channel 2 extending along a front vertical side, a spout 8 in communication with a top part of channel 2, a bottom inlet 4 of channel 2, and an air chamber 6. Container 1 is provided with an opening covered by screw-cap 14 for filling reservoir 3, and channel 2 is provided with graduation marks or lines 12 to serve as indicating means for measuring a level of a bubble therein.

Channel 2 is shown in FIG. 1 as having at its lower end a deviation 5 toward the center of reservoir 3 giving rise to chamber 6. Chamber 6, inlet 4, shelf 10 and passage 11 form air trap means in communication with channel 2 at the top and reservoir 3 at the bottom.

Figure 2:
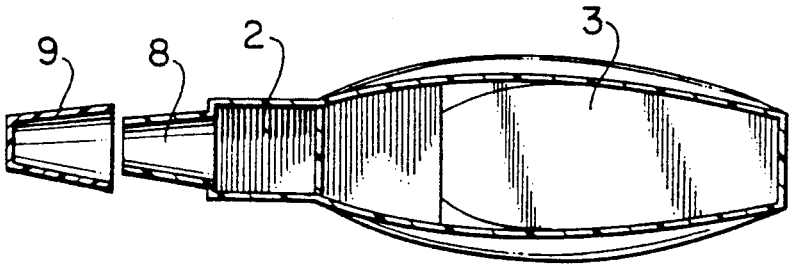
FIG. 2 is a horizontal cross-section of the squeeze container of FIG. 1 about line A.

FIG. 2 shows the horizontal cross-section of the essentially ellipsoid shaped reservoir 3, the essentially square shaped horizontal cross section of channel 2, spout 8 and cap 9.

Figure 3:
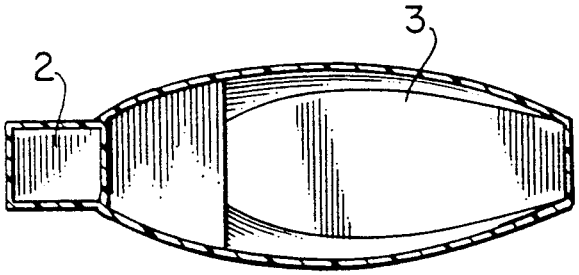
FIG. 3 is a horizontal cross-section of the squeeze container of FIG. 1 about line B.

FIG. 3 shows the horizontal cross-section of the essentially ellipsoid shaped reservoir 3 at nearly full extension in the minor axis of the ellipsoid, and the essentially square shaped horizontal cross section of channel 2.

Figure 4:
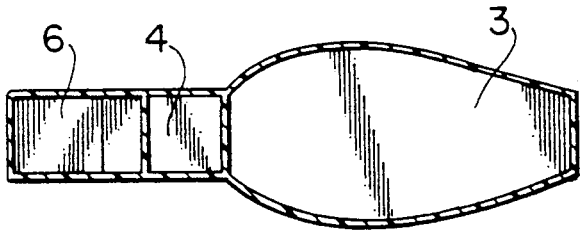
FIG. 4 is a horizontal cross-section of the squeeze container of FIG. 1 about line C.

FIG. 4 shows the horizontal cross-section of container 1 and air trap means including air chamber 6 and inlet 4. The essentially ellipsoid section of reservoir 3 is reduced in the minor axis from that of FIG. 3 since the vertical cross section of reservoir 3 is similarly essentially ellipsoid.

Figure 5:
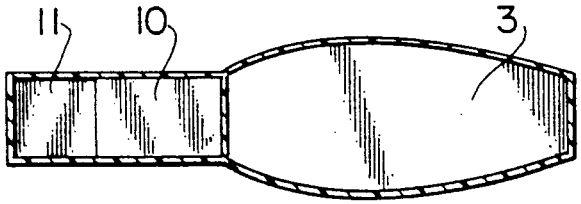
FIG. 5 is a horizontal cross-section of the squeeze container of FIG. 1 about line D.
Figure 6:
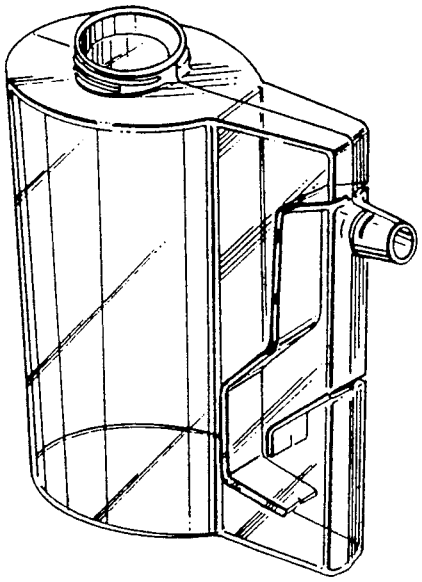
FIG. 6 is a perspective view of an embodiment similar to the preferred embodiment.

FIG. 5 shows the horizontal cross-section of container 1 along the line of shelf 10 of the passage 11 interconnecting reservoir 3 with the air trap means.

With reference to FIG. 1, shelf 10 extends from the right side wall of inlet 4 to a position under chamber 6. The position of the left side of shelf 10 is such that flow from passage 11 rises into chamber 6 at the left side thereof so that an air bubble is thereby pushed down and out from the right side of the chamber and into inlet 4.

When the reservoir is partly filled with honey, a measured quantity may be dispensed as follows:

1) bottle 1 is squeezed until the level of honey in channel 2 reaches the top of channel 2 and begins to enter spout 8.

2) bottle 1 is tilted from vertical as if to pour the honey from spout 8, placed over the beverage where the honey is desired, and further pressure is applied to the bottle 1 to begin dispensing the liquid. An air bubble is released from chamber 6 into inlet 4 of channel 2.

3) When the air bubble is emitted at spout 8 (this is easily detectable by the interruption in the flow of honey out of spout 8), pressure is released and bottle 1 is returned to rest on a level surface. The measured quantity of liquid is thus dispensed. Squeeze bottle 1 then draws air through spout 8 and channel 2 into reservoir 3 until bottle 1 regains its natural shape. As air is drawn through inlet 4 and passage 11, air chamber 6 is replenished with air and the bottle 1 is ready for its next dispensation.

By this method, a predetermined quantity is dispensed. In the preferred embodiment, this quantity is a volume of honey having the sweetness of one teaspoon of sugar. A little more honey can be dispensed by squeezing a little more after the bubble is emitted from the spout 8. Quantities less than one teaspoon may be dispensed by stopping the squeezing before the bubble reaches the spout 8. For this purpose, graduations 12 are provided on the transparent or translucid channel 2 so that squeezing may be stopped at a calibrated point such as one half teaspoon.

When container 1 is not in use, cap 9 shown in cross-section in FIGS. 1 and 2 is used as closure means to seal out air from channel 2, so that the honey stays fresh.

The bubble is released in the method described above by the action of the honey flow across the base of the chamber 6 as well as by tilting the container 1 to pour the honey from spout 8. Although it is a bit slower, one may cause a bubble to be released from chamber 6 by tilting alone. The chamber, being also made of the same resilient material as the rest of the container 1, may also be squeezed to release the bubble. Any one or any combination of the above mentioned three ways can be used to cause the air trap means to release the bubble.

Although the invention has been described as using the example of a bottle 1 having squeezable sides, it is to be understood that other pressure generating means are possible according to the invention, such as a pump or "accordion" section of the bottle. The closure means could also include a suitable valve provided either in the spout 8 or channel 2. The air chamber 6 can be located at other positions with respect to inlet 4.

Although only one channel 2 and air trap means are shown in the Figures, it is of course possible according to the invention to provide container 1 with two or more channels and air trap means. Two channels and air trap means can be advantageous under certain conditions. The exact dimensions of the height, and cross-sectional area of the channel, and the number of channels and air trap means, are parameters to be determined by one skilled in the art. The factors to be considered are the viscosity of the liquid, surface tension and the maximum desired quantity of liquid to be dispensed. The pressure generating means must be able to expel enough liquid into the measuring channel 2 for measuring, then must expel the desired quantity out the spout 8. Thus in the case of the squeeze-bottle 1, reservoir 3 must be capable when squeezed to expel a maximum of a little more than twice the maximum desired quantity to be dispensed. In the preferred embodiment, honey is dispensed for coffee or tea, and so reservoir 3 is preferably able to expel a little more than one teaspoon (ca. 5 mL) meaning that a little more than two teaspoons is suitable (ca. 10 mL). It has been determined for an average liquid honey in the case of a square section channel 2 that the channel section should be dimensioned between 12 mm by 12 mm to 17 mm by 17 mm and preferably 14 mm by 14 mm. If the channel dimensions are too large, it is then more possible that the viscous liquid can flow around the bubble thus making the measurement inaccurate. If the channel dimensions are too small then the viscous resistance becomes great and the required length of the channel to measure a substantial quantity becomes very long.

It is to be understood that the above description of the preferred embodiment is not to be limitative of the scope of the invention as defined in the appended claims.

I claim:

1. A squeeze-container for dispensing a viscous liquid comprising:

a reservoir for holding the liquid, at least a part of the reservoir being resiliently squeezable;

a substantially vertical measuring channel having a cross-section suited to allow a bubble of air in the liquid to move along the channel with a flow of the liquid therein, the bubble in the channel for measuring therein a quantity of the liquid to be dispensed;

a spout in communication with an upper part of the channel; and air trap means including an air chamber and means for forming a passage, a lower end of the channel being in communication with one side of the chamber, and the passage communicating an opposite side of the chamber with the reservoir, whereby upon squeezing of the reservoir the flow of the liquid across the chamber from the opposite side to the one side is able in use to release the air bubble from the chamber into said lower end and upon release of pressure on the reservoir to replenish the chamber with air.

2. Squeeze-container as claimed in claim 1, wherein the flow leaving the passage into the air chamber is directed towards a top of the chamber, such that said flow from the passage to the channel pushes into the chamber and forces the bubble out of the chamber at said one side.

3. Squeeze-container as claimed in claim 2, wherein said chamber is located forward of said lower end of the channel such that said container may be tilted in a direction of the spout to help release the bubble.

4. Squeeze-container as claimed in claim 2, wherein the channel is provided outside said reservoir.

5. Squeeze-container as claimed in claim 2, wherein the container is integrally moulded from a transparent or translucid plastic material.

6. Squeeze-container as claimed in claim 1, further comprising closure means to close fluid communication between an exterior of the container and the channel.

7. Squeeze-container as claimed in claim 6, wherein said closure means comprise a cap for the spout.

8. Squeeze-container as claimed in claim 1, further comprising a fill opening on a wall of the reservoir, the opening to be covered and sealed by a screw cap, such that the reservoir may be filled and refilled.

9. Squeeze-container as claimed in claim 1, further comprising graduation lines on the channel, the channel being transparent to make the bubble visible; such that the bubble in conjuction with the graduation lines may be used to indicate a part of the quantity dispensed.

10. Squeeze-container as claimed in claim 1, wherein the channel is provided outside said reservoir.

11. Squeeze-container as claimed in claim 1, wherein said part of the reservoir being squeezable comprises two substantially ellipsoid-shaped major sides, the reservoir having a substantially flat bottom, a top and two relatively small minor sides, the channel being provided at one of said two minor sides.

12. Squeeze-container as claimed in claim 1, wherein the container is integrally moulded from a transparent or translucid plastic material.

13. Squeeze-container as claimed in claim 1, wherein in use the viscous liquid is honey, and wherein said cross-section is substantially square shaped and measures between 12 mm by 12 mm and 17 mm by 17 mm.

* * * * *